US011820964B2

(12) United States Patent
Barr et al.

(10) Patent No.: US 11,820,964 B2
(45) Date of Patent: Nov. 21, 2023

(54) SOLID LAUNDRY PRODUCT CONTAINING POLYETHYLENE GLYCOL AND COLOR-STABILIZING STARCH

(71) Applicant: Conopco, Inc., Englewood Cliffs, NJ (US)

(72) Inventors: Helen Angela Barr, Ellesmere Port (GB); Karl Burgess, Wirral (GB); Hugh Rieley, Wirral (GB); Shaun Charles Walsh, Cheadle (GB)

(73) Assignee: Conopco, Inc., Englewood Cliffs, NJ (US)

( * ) Notice: Subject to any disclaimer, the term of this patent is extended or adjusted under 35 U.S.C. 154(b) by 1158 days.

(21) Appl. No.: 16/070,376

(22) PCT Filed: Dec. 20, 2016

(86) PCT No.: PCT/EP2016/081974
§ 371 (c)(1),
(2) Date: Jul. 16, 2018

(87) PCT Pub. No.: WO2017/125235
PCT Pub. Date: Jul. 27, 2017

(65) Prior Publication Data

US 2022/0064573 A1 Mar. 3, 2022

(30) Foreign Application Priority Data

Jan. 21, 2016 (EP) ..... 16152254

(51) Int. Cl.

| | |
|---|---|
| ***C11D 3/50*** | (2006.01) |
| ***C11D 3/20*** | (2006.01) |
| ***C11D 3/22*** | (2006.01) |
| ***C11D 3/37*** | (2006.01) |
| ***C11D 17/00*** | (2006.01) |

(52) U.S. Cl.
CPC ..... *C11D 3/2072* (2013.01); *C11D 3/222* (2013.01); *C11D 3/3707* (2013.01); *C11D 17/003* (2013.01); *C11D 3/50* (2013.01); *C11D 17/0039* (2013.01)

(58) Field of Classification Search
CPC ..... C11D 17/043; C11D 3/50; C11D 3/505; C11D 17/0047; C11D 3/3707; C11D 9/44; C11D 11/0017; C11D 17/0069; C11D 17/042; C11D 9/225
See application file for complete search history.

(56) References Cited

U.S. PATENT DOCUMENTS

| | | | | |
|---|---|---|---|---|
| 7,186,680 | B2 * | 3/2007 | Caswell | C11D 3/0036 512/4 |
| 7,871,976 | B1 * | 1/2011 | Aouad | C08L 71/02 512/2 |
| 9,347,022 | B1 * | 5/2016 | Frentzel | D06M 13/17 |
| 10,266,797 | B2 * | 4/2019 | Burgess | C11D 3/50 |
| 10,633,613 | B2 * | 4/2020 | Burgess | C11D 3/3707 |
| 10,731,113 | B2 * | 8/2020 | Burgess | C11D 3/227 |
| 11,078,444 | B2 * | 8/2021 | Burgess | C11D 3/3707 |
| 2002/0010105 | A1 * | 1/2002 | Bacon | C11D 17/0069 510/101 |
| 2010/0113616 | A1 | 5/2010 | Gerke et al. | |
| 2016/0024443 | A1 * | 1/2016 | Aouad | C11D 11/0017 512/4 |
| 2022/0064573 | A1 | 3/2022 | Barr et al. | |

FOREIGN PATENT DOCUMENTS

| | | | |
|---|---|---|---|
| CN | 102597204 | | 7/2012 |
| CN | 104726199 | | 6/2015 |
| EP | 3405558 | B1 | 10/2019 |
| JP | 3234797 | | 10/1991 |
| JP | 5214361 | | 8/1993 |
| JP | 2010037691 | | 2/2010 |
| WO | WO2002089862 | | 11/2002 |
| WO | WO2004070017 | | 8/2004 |
| WO | WO2007013901 | | 2/2007 |
| WO | WO 2008/009521 | * | 1/2008 |
| WO | WO2011056938 | | 5/2011 |
| WO | WO2016099852 | | 6/2016 |
| WO | WO2017125235 | | 7/2017 |

OTHER PUBLICATIONS

Notice of Opposition for EP16812770.2 dated Jul. 14, 202.*
IPRP2 in PCTEP2016081974; May 8, 2018.
Rodriquez et al.; Amylose—Vanillin Complexation Assessed by a Joint Experimental and Theoretical Analysis; Journal of Physical Chemistry C; 2011; pp. 23315-23322; XP055288818; vol. 115, No. 47.
Search Report & Written Opinion in EP16152254; dated Aug. 8, 2016.
Search Report and Written Opinion in PCTEP2016081974; dated Feb. 28, 2017.
Written Opinion 2 in PCTEP2016081974; dated Jan. 25, 2018.
Rutgers; Starch and Vanillin; Journal of the Science of Food and Agriculture; Dec. 1, 1955; 735-738; vol. 6.
Rodriguez et al.; Host-Guest Molecular Interactions in Vanillin/Amylose Inclusion; Applied Spectroscopy; Jan. 1, 2013; 884-891; vol. 67 No. 8.
Tari et al.; Starch-based spherical aggregates: stability of a model flavouring compound, vanillin entrapped therein; Carbohydrate Polymers; 2002; pp. 417-421; 50.
Sangsuwan et al.; Effects of Vanillan and Plasticizer on Properties of Chitosan-Methyl Cellulose Based Film; J. Applied Polymer Sci. ; 2008; pp. 3540-3545; 109(6).
Zhu et al.; Eutectic-forming binary system of poly(ethylene oxide) and p-hydroxybenzaldehyde; Polymer International; 2003; pp. 813-818; 52.

(Continued)

*Primary Examiner* — Charles I Boyer
(74) *Attorney, Agent, or Firm* — Carter, DeLuca & Farrell LLP; George Likourezos; Bret P. Shapiro

(57) ABSTRACT

A laundry product comprising; polyethylene glycol having a molecular weight of 2 000 to 30 000; and free oil perfume comprising phenolic aldehyde, characterised in that the composition further comprises at least 1 w.t. % of starch or starch derivative.

11 Claims, No Drawings

(56) References Cited

OTHER PUBLICATIONS

Arvisenet et al.; Retention of Aroma Compounds in Starch Matrices: Competitions between Aroma Compounds toward Amylose an Amylopectin; J. Agric. Food Chem.; 2002; pp. 7345-7349; 50.
Tari et al.; Starch-based spherical aggregates: screening of small granule sized starches for entrapment of a model flavouring compound, vanillin; Carbohydrate Polymers; 2003; pp. 45-51; 53.
Bauer et al., Common Fragrances and Flavor materials: preparation, Properties and uses, 1997, pp. 128-134.

* cited by examiner

SOLID LAUNDRY PRODUCT CONTAINING POLYETHYLENE GLYCOL AND COLOR-STABILIZING STARCH

TECHNICAL FIELD

This invention relates to laundry products of the type that a consumer may add to the laundry process to boost or adjust fragrance.

BACKGROUND

WO2011/056938 describes a laundry scent additive shaped in a pastille and comprising polyethylene glycol (PEG) and perfume. The additive is said to enable consumers to control the amount of scent imparted to their laundry. The preferred embodiment consists essentially of 80 to 91 wt % of polyethylene glycol, 2 to 12 wt % free perfume and 2 to 12 wt % friable microcapsules of encapsulated perfume. In such a composition it is said that the free perfume can provide for a pleasant scent experience to the user upon opening the package containing the composition and as the user pours the composition into a dosing device and transfers the composition to her washing machine. Specific perfume types are not disclosed in this document. Because the free oil perfume performs a different function from the encapsulated perfume it is not feasible to put any components of the free oil perfume into the microcapsules to prevent unwanted interactions with the remainder of the scent additive.

The poor stability of vanillin and other aromatic aldehydes, in particular in highly alkaline or acidic compositions has been noted in numerous documents. For instance: JP 03/234797 (Lion) discloses the use of C8-10 fatty acids to reduce the discolouration caused by denaturing perfumes (eugenol, isoeugenol, isobutylquinoline, musk ketone, coumarin, heliotropin or helional (sic) as well as vanillin or ethylvanillin) in soap compositions. JP 05/214361 (Kao, 24 Aug. 1993) highlights the stability problems/colour change of (ethyl)vanillin by acid, base or anionic active agents. WO 2007/013901 (Flexitral) discusses the discolouration of soap and detergent products due to the formation of polyphenols from vanillin (derivatives) in the presence of light and alkaline conditions. JP 2010/037691 (Kao) discloses the use of anti-oxidants to improve the stability of aldehyde perfumes (including the vanillin based compounds) in (acidic) fabric conditioner compositions. US 2010/0113616 (Henkel) discloses the use of iodide salts to inhibit the discolouration of soaps and solid washing compositions by vanillin or its fragrance derivatives.

Laundry scent additives typically have neutral pH and so, based on these disclosures, the skilled worker could conclude that the problem would not occur in these products. It is also doubtful whether these materials added at low levels would be sufficiently well distributed to stabilise low levels of perfume in a solid matrix, as is found in a laundry scent additive.

A relatively high level of >80 wt % PEG is used in WO2011/056938. This means that there is at least is 6 times excess of PEG over free perfume and a corresponding further excess of PEG over the problem perfume components.

Zhu et al., Polym Int. (2003) Vol 52(5), p 813-8 discusses the interaction (hydrogen bonding) between PEG and p-Hydroxybenzaldehyde. PEO (poly ethylene oxide) with a molecular weight of 6000 is considered to be PEG. p-Hydroxybenzaldehyde is an aromatic aldehyde. The work showed that hydrogen bonding between the aldehyde and the PEG occurred and impacted on PEG morphology.

It was considered that this known interaction between aromatic aldehyde and PEG could contribute to improved stability by reducing any other reactions of the aromatic aldehyde. It was also considered likely that if a large excess of PEG were used then the reactions of the aromatic aldehyde with PEG would dominate its behaviour.

However, we found that when certain perfume types are incorporated as free perfume into a PEG based scent additive they cause discoloration to form on storage. The perfume components that we have found give rise to this problem are the phenolic (aromatic) aldehydes, in particular: vanillin and ethylvanillin. There remains a need to reduce discolouration of PEG based scent additives.

Rutgers, J. Sci. Food & Agric. (1955) Vol 6, p 735-8 suggests that vanillin may bind loosely to starch.

Rodriguez & Bemik, Appld. Spec. (2013) Vol 67(8), p 884-891 discusses the molecular interactions in vanillin/amylose inclusion complexes in amylose-rich starch. They suggest that the type of starch has an effect on binding with vanillin.

However it appears to be unpublished, how stability is affected if vanillin or other phenolic aldehydes are formulated with a mixture of starch and PEG.

SUMMARY OF THE INVENTION

According to the present invention there is provided a laundry product for the addition of perfume to the laundry process. The laundry product comprising;

polyethylene glycol having a molecular weight of 2 000 to 30 000; and free oil perfume comprising phenolic aldehyde, characterised in that the composition further comprises at least 1 w.t. % of starch or starch derivative.

Addition of a minor amount of starch to the major amount of PEG in the composition prior to forming the laundry product comprising the aromatic aldehyde free oil perfume components, has surprisingly been found to considerably improve their colour stability compared to the use of PEG without any starch. This is surprising because it is known that the aromatic aldehydes hydrogen bond to the PEG and it was assumed that this interaction would predominate when high levels of PEG were used. The mechanism operating for the starch to give this stabilising effect in the presence of the PEG is not well understood, but it has been demonstrated experimentally.

Preferred aromatic aldehyde perfume components are vanillin and ethylvanillin, most preferred is vanillin. It is desirable to include this perfume component into particulate scent additives because it is a common component of fabric conditioner fragrances and consumers wish their scent additive to be compatible with their fabric conditioner.

DETAILED DESCRIPTION OF THE INVENTION

Some of the key perfumes used in fabric conditioners are phenolic aldehydes. As disclosed in WO2011/056938 the scent of the laundry scent additive may be coordinated with the scent(s) of other fabric care products. Indeed we have found such coordination, particularly with fabric conditioner, to be highly desirable. However, we have found that inclusion of phenolic aldehyde free oil perfume components into the polyethylene glycol based laundry scent additives described in WO2011/056938 gives rise to noticeable unsightly red/brown discoloration after 2 to 4 weeks storage at 50° C.

Surprisingly we have found that addition of a small amount of starch to the additive reduces and delays the discoloration.

Free Oil Perfume

The free oil of the current invention comprises at least one phenolic aldehyde component.

Preferred phenolic aldehyde components include vanillin, derivatives of vanillin, ethyl vanillin and derivatives of ethyl vanillin.

The two most preferred phenolic aldehyde components are:

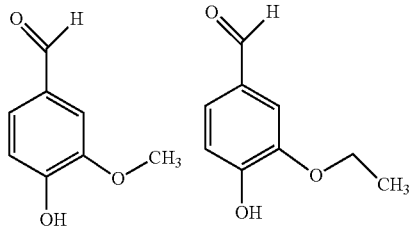

Vanillin and ethylvanillin and mixtures thereof.

The most preferred phenolic aldehyde component is vanillin.

The laundry products of the current invention comprise at least 3% w.t. free oil, preferably 3 to 12 w.t. % free oil, more preferably 4 to 10 w.t. % and most preferably 5 to 9 w.t % free oil.

The free oil perfume may comprise any level of phenolic aldehyde components. However preferably it comprises 0.5 to 15 w.t. % phenolic aldehyde components, more preferably, 1 to 12 w.t %, most preferably 1 to 10 w.t. % phenolic aldehyde components.

Polyethylene Glycol (PEG)

The current invention comprises PEG. PEG is the polymer of ethylene oxide. The PEG polymer can be made in a variety of different molecular weights. A suitable molecular weight of the PEG is 2,000 to 30,000, more preferably from 2,000 to 20,000, most preferably from 4,000 to 12,000.

When discussing molecular weight of polyethylene glycol (PEG) it is appreciated that the molecular weight of polyethylene glycol is an average molecular weight.

The laundry product preferably comprises from 50 to 95 wt. % of polyethylene glycol. A preferred level of PEG is from 55 to 95 wt. %, more preferably from 60 to 90 wt. %.

Starch

Starch and starch derivatives protect from colour change at levels as low as 1 w.t. %. A more satisfactory result is achieved with levels of from 5 to 40 w.t. % more preferably 5 to 35, even more preferably 5-30 w.t. %.

Preferably the starch is a low amylose starch, in this context a low amylose starch is considered to be a starch comprising less than 25 w.t. % amylose. i.e. 0.001 to 25 w.t. % amylose.

A non-limiting list of low amylose starches includes; Tapioca (also referred to as Cassava), Sweet potato, potato and Arrowroot.

Preferably the starch has an amylose content of 0.001 to 21 w.t %. A preferred low amylose starch is Tapioca.

Starch derivatives, also known as modified starch, are prepared by physically, enzymatically, or chemically treating native starch to change its properties.

Optional Dyes and Pigments

Colour may optionally be provided to the laundry product by the addition of one or more colorants. The colorant comprises one or more dyes and/or pigments. The pigment/dye may be any colour. These may be substantive or non-substantive dyes/pigments. For substantive dyes/pigments a blue or violet colour is preferred. A preferred level is one where the colour is discernible to the consumer and aesthetically pleasing. The laundry products may be a plurality of colours.

Pigment

Pigments may be selected from inorganic and organic pigments, most preferably the pigments are organic pigments.

Pigments are described in Industrial Inorganic Pigments edited by G. Buxbaum and G. Pfaff ($3^{rd}$ edition Wiley-VCH 2005). Suitable organic pigments are described in Industrial Organic Pigments edited by W. Herbst and K. Hunger ($3^{rd}$ edition Wiley-VCH 2004). Pigments are listed in the colour index international© Society of Dyers and Colourists and American Association of Textile Chemists and Colorists 2002.

Pigments are practically insoluble coloured particles, preferably they have a primary particle size of 0.02 to 10 μm, where the distance represent the longest dimension of the primary particle. The primary particle size is measured by scanning electron microscopy. Most preferably the organic pigments have a primary particle size between 0.02 and 0.2 μm.

By practically insoluble we mean having a water solubility of less than 500 part per trillion (ppt), preferably 10 ppt at 20° C. with a 10 wt % surfactant solution.

Organic pigments are preferably selected from monoazo pigments, beta-naphthol pigments, naphthol AS pigments, benzimidazolone pigments, metal complex pigments, isoindolinone and isoindoline pigments, phthalocyanine pigments, quinacridone pigments, perylene and perinone pigments, diketopyrrolo-pyrrole pigments, thioindigo pigments, anthraquinone pigments, anthrapyrmidine pigments, flavanthrone pigments, anthanthrone pigments, dioxazine pigments and quinophthalone pigments.

Preferred pigments are pigment green 8, pigment blue 28, pigment yellow 1, pigment yellow 3, pigment orange 1, pigment red 4, pigment red 3, pigment red 22, pigment red 112, pigment red 7, pigment brown 1, pigment red 5, pigment red 68, pigment red 51, pigment 53, pigment red 53:1, pigment red 49, pigment red 49:1, pigment red 49:2, pigment red 49:3, pigment red 64:1, pigment red 57, pigment red 57:1, pigment red 48, pigment red 63:1, pigment yellow 16, pigment yellow 12, pigment yellow 13, pigment yellow 83, pigment orange 13, pigment violet 23, pigment red 83, pigment blue 60, pigment blue 64, pigment orange 43, pigment blue 66, pigment blue 63, pigment violet 36, pigment violet 19, pigment red 122, pigment blue 16, pigment blue 15, pigment blue 15:1, pigment blue 15:2, pigment blue 15:3, pigment blue 15:4, pigment blue 15:6, pigment green 7, pigment green 36, pigment blue 29, pigment green 24, pigment red 101:1, pigment green 17, pigment green 18, pigment green 14, pigment brown 6, pigment blue 27 and pigment violet 16.

Cosmenyl Green, Cosmenyl Yellow, Cosmenyl Blue and Cosmenyl Red are preferred commercially available pigments.

Dye

Dyes are described in Industrial Dyes edited by K. Hunger 2003 Wiley-VCH ISBN 3-527-30426-6.

Dyes for use in the current invention are selected from cationic, anionic and non-ionic dyes.

The dyes may be alkoxylated. Alkoxylated dyes are preferably of the following generic form: Dye-$NR_1R_2$. The $NR_1R_2$ group is attached to an aromatic ring of the dye. $R_1$ and $R_2$ are independently selected from polyoxyalkylene chains having 2 or more repeating units and preferably having 2 to 20 repeating units. Examples of polyoxyalkylene chains include ethylene oxide, propylene oxide, glycidol oxide, butylene oxide and mixtures thereof.

Preferably the dye is selected from acid dyes; disperse dyes and alkoxylated dyes.

Most preferably the dye is an anionic or non-ionic dye. It is even more preferred that the dye is a non-ionic dye.

Preferably the dye is selected from those having: anthraquinone; mono-azo; bis-azo; xanthene; phthalocyanine; and, phenazine chromophores. More preferably the dye is selected from those having: anthraquinone and, mono-azo chromophores.

The dye may be any colour, preferably the dye is blue, violet, green or red.

Preferably the dye is selected from: acid blue 80, acid blue 62, acid violet 43, acid green 25, direct blue 86, acid blue 59, acid blue 98, direct violet 9, direct violet 99, direct violet 35, direct violet 51, acid violet 50, acid yellow 3, acid red 94, acid red 51, acid red 95, acid red 92, acid red 98, acid red 87, acid yellow 73, acid red 50, acid violet 9, acid red 52, food black 1, food black 2, acid red 163, acid black 1, acid orange 24, acid yellow 23, acid yellow 40, acid yellow 11, acid red 180, acid red 155, acid red 1, acid red 33, acid red 41, acid red 19, acid orange 10, acid red 27, acid red 26, acid orange 20, acid orange 6, sulphonated Al and Zn phthalocyanines, solvent violet 13, disperse violet 26, disperse violet 28, solvent green 3, solvent blue 63, disperse blue 56, disperse violet 27, solvent yellow 33, disperse blue 79:1.

The dye may be covalently bound to polymeric species.

Optional Microcapsules

The laundry product may optionally comprise microcapsules, encapsulating a functional composition. The microcapsules of the current invention may be moisture activated or pressure activated, they are preferably pressure activated which is also referred to as friable.

The microcapsules comprise a core and a shell. The shell comprises a suitable encapsulating material, examples of which include aminoplasts, proteins, polyurethanes, polyacrylates, polymethacrylates, polysaccharides, polyamides, polyolefins, gums, silicones, lipids, modified cellulose, polyphosphate, polystyrene, polyesters or combinations of these materials.

Additionally, microcapsules made via the simple or complex coacervation of gelatin may be used. Microcapsules having shells comprised of polyurethane, polyamide, polyolefin, polysaccaharide, protein, silicone, lipid, gums, polyacrylate, polystyrene, and polyesters or combinations of these materials may also be used.

Preferably the shell encapsulating polymers comprise aminoplast polymers, more preferably the aminoplast polymers comprise melamine formaldehyde or urea formaldehyde condensates, or co-polyacrylamide/acrylate with a methylated melamine crosslinker. Most preferably the encapsulating shell comprises melamine formaldehyde.

Encapsulation can provide pore vacancies or interstitial openings depending on the encapsulation techniques employed.

Fragrance capsules known in the art and suitable for use in the present invention comprise a shell comprising a three-dimensional cross-linked network of an aminoplast resin, more specifically a substituted or un-substituted acrylic acid polymer or co-polymer cross-linked with a urea-formaldehyde pre-condensate or a melamine-formaldehyde pre-condensate.

In the compositions described herein, benefit agents are hydrophobic materials that can provide a beneficial effect to a fabric. The preferred benefit agents according to the present invention have a ClogP greater than 0.5.

Preferred benefit agents include perfumes, lubricants and any other oily materials. Particularly preferred benefit agents include, but are not limited to, the following:

- silicone oils, resins, and modifications thereof such as linear and cyclic polydimethylsiloxanes, amino-modified, allcyl, aryl, and alkylaryl silicone oils, which preferably have a viscosity of greater than 50,000 cst;
- perfume components including fragrance, perfumery, and essential oils and resins, aromatherapy actives and pro-fragrance materials;
- insect repellents
- organic sunscreen actives, for example, octylmethoxy cinnamate;
- antimicrobial agents, for example, 2-hydroxy-4, 2,4-trichlorodiphenylether;
- ester solvents; for example, isopropyl myristate;
- lipids and lipid like substance, for example, cholesterol;
- hydrocarbons such as paraffins, petrolatum, and mineral oil
- fish and vegetable oils;
- hydrophobic plant extracts;
- waxes;
- pigments including inorganic compounds with hydrophobically-modified surface and/or dispersed in an oil or a hydrophobic liquid, and;
- sugar-esters, such as sucrose polyester (SPE).

The most preferred benefit agents are perfume components. Perfume components include both odiferous materials and pro-fragrance materials.

The microcapsules for use in the invention may further comprise a carrier oil in the core. The carrier oils are hydrophobic materials that are miscible in the volatile benefit agent materials used in the present invention. Suitable oils are those having reasonable affinity for the benefit agent. Where the benefit agent is a perfume, suitable materials include, but are not limited to triglyceride oil, mono and diglycerides, mineral oil, silicone oil, diethyl phthalate, polyalpha olefins, castor oil and isopropyl myristate. Preferably, the oil is a triglyceride oil, most preferably a capric/caprylic triglyceride oil.

The microcapsule may further comprise a coating on the encapsulating shell material and/or a deposition aid which may be covalently attached.

The microcapsules of the present invention may comprise a mix of microcapsules comprising different shell materials and/or different benefit agents.

If the microcapsules are supplied in a slurry, the laundry products of the current invention may comprise a small amount of water.

Further Functional Ingredients

The laundry products may optionally comprise one or more further functional ingredients, which are not encapsulated. A non-limiting list of such further optional functional ingredients include; shading dye, enzyme, antiredeposition polymer, dye transfer inhibiting polymer, soil release polymer, sequestrant, and/or fluorescent agent.

Shading Dye

Shading dyes deposit to fabric during the wash or rinse step of the washing process providing a visible hue to the fabric. Shading of white garments may be done with any colour depending on consumer preference. Blue and Violet are particularly preferred shades and consequently preferred dyes or mixtures of dyes are ones that give a blue or violet shade on white fabrics. The shading dyes used are preferably blue or violet.

The shading dye chromophore is preferably selected from the group comprising: mono-azo, bis-azo, triphenylmethane, triphenodioxazine, phthalocyanin, naptholactam, azine and anthraquinone. Most preferably mono-azo, bis-azo, azine and anthraquinone.

Most preferably the dye bears at least one sulfonate group.

Preferred shading dyes are selected from direct dyes, acid dyes, hydrophobic dyes, cationic dyes and reactive dyes.

If included, the shading dye is preferably present is present in the composition in range from 0.0001 to 0.01 wt %.

Dye Transfer Inhibitors

Modern detergent compositions typically employ polymers as so-called 'dye-transfer inhibitors'. These prevent migration of dyes, especially during long soak times. Generally, such dye-transfer inhibiting agents include polyvinyl pyrrolidone polymers, polyamine N-oxide polymers, copolymers of N-vinylpyrrolidone and N-vinylimidazole, manganese pthalocyanine, peroxidases, and mixtures thereof, and are usually present at a level of from 0.01 to 10 wt. % based on total amount in the laundry composition.

Soil Release Polymers

Soil release polymers are designed to modify the surface of the fabric to facilitate the easier removal of soil. Typically soil release polymers are based on or derivatives of polyethylene glycol/vinyl acetate copolymers or polyethylene glycol terephthalate polyesters.

Fluorescent Agent

The composition may comprise a fluorescent agent (optical brightener). Fluorescent agents are well known and many such fluorescent agents are available commercially. Usually, these fluorescent agents are supplied and used in the form of their alkali metal salts, for example, the sodium salts. The total amount of the fluorescent agent or agents used in the composition is generally from 0.005 to 2 wt. %, more preferably 0.01 to 0.1 wt. %.

Form of the Laundry Product

The laundry product may be shaped into any suitable form by any suitable means. For example the laundry product may be formed by casting, spraying, pastillation, or prilling.

The laundry product of the current invention may be a singular object or a plurality of smaller objects e.g. a plurality of pastillies.

Preferably the laundry product is in the form of pastilles.

During pastilation, the pastille composition is melted then maintained at a temperature of 60° C.+/−10° C., then pumped onto a perforated cylinder which is perforated in the desired shape of the final product. The melt is then delivered to a chilled steel belt to rapidly cool and solidify the pastille.

The pastille can be processed into any desirable shape, including circular shapes, spheres, ovals, lozenges and the like. Preferably the shape is hemispherical of domed.

A preferred mass of a pastille is from 0.02 to 0.15 g, more preferably the mass of the pastille is 0.03 to 0.1 g, most preferably 0.04 g to 0.09 g.

The invention will now be further described with reference to the following non-limiting examples.

EXAMPLES

Formulations:

Composition A—74% PEG[1] & 26% Tapioca[2], no free oil perfume

Composition B—93% PEG[1] Only & 7% free oil perfume[3], no Tapioca

Composition 1—88% PEG[1] & 5% Tapioca[2] & 7% free oil perfume[3]

Composition 2—83% PEG[1] & 10% Tapioca[2] & 7% free oil perfume[3]

Composition 3—67% PEG[1] & 26% Tapioca[2] & 7% free oil perfume[3]

PEG[1]—Poly ethylene glycol 8000 ex. Clarient

Tapioca[2]—Tapioca Pure ex. Akzo Nobel, Tapioca starch is a naturally occurring starch having an amylose content of between 15 to 18%, typically 17%

Free oil perfume[3]—a perfume composition comprising 2.5 to 5 w.t. % Vanillin ex. Firmenich Method of Producing the Laundry Products The PEG was melted in a container at around 70° C., this temperature was maintained throughout the mixing steps to avoid premature solidification.

For compositions containing starch, starch was then added to the PEG and mixed thoroughly.

When homogeneous the free perfume oil was then added and mixed until homogeneous The mix was then cast on a cold stainless steel plate and allowed to cool. It was then broken into suitably sized pieces.

An initial colour measurement was taken for each sample. They were then stored at 50° C. and further colour measurements were taken at 1, 2 and 6 weeks, as shown in Table 1.

ΔE is a standard measure of colour change. This was measured using a X-Rite VS450 supplied by the X-Rite Corporation of 4300 44th St. SE Grand Rapids, Mich. 49512 USA.

TABLE 1

| 50° C. | | | | |
|---|---|---|---|---|
| | ΔE | | | |
| Composition | Initial reading | 1 week | 2 weeks | 6 weeks |
| A | 0 | 0.82 | 2.04 | 4.06 |
| B | 0 | 12.36 | 15.85 | 24.37 |
| 1 | 0 | 4.96 | 8.02 | 11.23 |
| 2 | 0 | 2.69 | 5.1 | 4.23 |
| 3 | 0 | 5.52 | 6.38 | 6.33 |

Composition A shows only a small colour change in a product containing only PEG and starch. Composition B however shows a large colour change over time in a product containing PEG and free oil perfumes. Compositions 1, 2 and 3 all demonstrate a significant decrease in colour change when starch is added to a PEG and free oil perfume composition.

The invention claimed is:

1. A laundry product comprising:

50 to 95 w.t. % polyethylene glycol having a molecular weight of 2,000 to 30,000;

a color stabilizing amount of at least 1 w.t. % starch with an amylose content less than 25 w.t. %. mixed with the polyethylene glycol; and free oil perfume comprising 0.5 to 15 w.t. % phenolic aldehyde components by total weight of perfume.

2. The laundry product according to claim 1, wherein the polyethylene glycol has a molecular weight in the range 2,000 to 20,000.

3. The laundry product according to claim 1, comprising at least 3 w.t. % free oil perfume.

4. The laundry product according to claim 1, wherein the phenolic aldehyde is selected from vanillin, ethyl vanillin and mixtures thereof.

5. The laundry product according to claim 4, wherein the phenolic aldehyde is vanillin.

6. The laundry product according to claim 1, comprising 5 to 40 w.t. % starch.

7. The laundry product according to claim 1, wherein the laundry product is a pastille.

8. The laundry product according to claim 7, wherein the mass of the pastille is 0.02 to 0.15 g.

9. The laundry product according to claim 1, wherein the laundry product further comprises microcapsules comprising a functional composition.

10. The laundry product according to claim 1, wherein the laundry product further comprises one or more dyes and/or pigments.

11. The laundry product according to claim 1, wherein the polyethylene glycol and the starch are combined and mixed until homogeneous and the free oil perfume is subsequently added to the mixture of polyethylene glycol and starch and further mixed until homogeneous.

* * * * *